US009170534B2

(12) United States Patent
Ishida

(10) Patent No.: US 9,170,534 B2
(45) Date of Patent: Oct. 27, 2015

(54) FIXING DEVICE PROVIDED WITH TEMPERATURE DETECTION UNIT

(71) Applicant: Brother Kogyo Kabushiki Kaisha, Nagoya-shi, Aichi-ken (JP)

(72) Inventor: Kei Ishida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/228,411

(22) Filed: Mar. 28, 2014

(65) Prior Publication Data

US 2014/0294467 A1 Oct. 2, 2014

(30) Foreign Application Priority Data

Mar. 28, 2013 (JP) ..... 2013-068489

(51) Int. Cl.
*G03G 15/20* (2006.01)

(52) U.S. Cl.
CPC ..... *G03G 15/2039* (2013.01); *G03G 15/2053* (2013.01); *G03G 2215/2035* (2013.01)

(58) Field of Classification Search
CPC ..... G03G 15/2039; G03G 15/2053; G03G 2215/2035
See application file for complete search history.

(56) References Cited

U.S. PATENT DOCUMENTS

2006/0269308 A1* 11/2006 Ishii ..... 399/69
2012/0201558 A1* 8/2012 Watanabe ..... 399/69

FOREIGN PATENT DOCUMENTS

JP H04-122969 A 4/1992
JP H09-292790 A 11/1997
JP H10-69187 A 3/1998

* cited by examiner

*Primary Examiner* — Ryan Walsh
(74) *Attorney, Agent, or Firm* — Banner & Witcoff, Ltd.

(57) ABSTRACT

A fixing device may include: a nip member; an endless belt; a heater; a temperature detection unit; and a biasing member. The endless belt may circularly move such that an inner peripheral surface thereof may move in a sliding direction at a position in sliding contact with the nip member. The temperature detection unit may include: a temperature sensor and a holder. The temperature sensor may detect a temperature of the inner peripheral surface and may include: a base and a sensor element supported at the base. The holder may support the base and may have a guide surface for guiding the inner peripheral surface. The guide surface may be disposed on at least one of first and second sides of the temperature sensor in a first direction extending along an axis of the endless belt. The biasing member may bias the holder toward the inner peripheral surface.

19 Claims, 8 Drawing Sheets

FIXING DEVICE PROVIDED WITH TEMPERATURE DETECTION UNIT

CROSS REFERENCE TO RELATED APPLICATION

This application claims priority from Japanese Patent Application No. 2013-068489 filed Mar. 28, 2013. The entire content of the priority application is incorporated herein by reference.

TECHNICAL FIELD

The present invention relates to a fixing device including a temperature sensor for detecting a temperature of an inner peripheral surface of an endless belt.

BACKGROUND

There is conventionally known a fixing device including a temperature sensor for detecting a temperature of an inner peripheral surface of an endless belt. In such a conventional fixing device, the temperature sensor is biased toward the inner peripheral surface by a spring or a sponge, thereby detecting the temperature of the inner peripheral surface.

SUMMARY

However, in this fixing device, the temperature sensor exerts a localized force on a portion of the endless belt with which the temperature sensor is in contact. This may cause damages to the endless belt.

In view of the foregoing, it is an object of the present invention to provide a fixing device capable of preventing a temperature sensor from exerting a localized force on an endless belt.

In order to attain the above and other objects, the present invention provides a fixing device that may include: a nip member; an endless belt; a heater; a temperature detection unit; and a biasing member. The endless belt may have an inner peripheral surface, and an axis extending in a first direction. The endless belt may have a first end on a first side in the first direction and a second end on a second side opposite to the first side in the first direction. The endless belt may be configured to circularly move such that the inner peripheral surface may move in a sliding direction at a position where the inner peripheral surface is in sliding contact with the nip member. The heater may be configured to heat the endless belt. The temperature detection unit may include: a temperature sensor and a holder. The temperature sensor may be configured to detect a temperature of the inner peripheral surface. The temperature sensor may include: a base; and a sensor element supported at the base. The holder may be configured to support the base. The holder may have a guide surface configured to guide the inner peripheral surface. The guide surface may be disposed on at least one of the first side and the second side of the temperature sensor. The biasing member may be configured to bias the holder toward the inner peripheral surface.

DETAILED DESCRIPTION

Next, a general structure of a color laser printer 1 provided with a fixing device 100 according to one embodiment of the present invention will be described with reference to FIG. 1. A detailed structure of the fixing device 100 will be described later while referring to FIG. 2.

Throughout the specification, the terms "upward", "downward", "upper", "lower", "above", "below", "beneath", "right", "left", "front", "rear" and the like will be used assuming that the color laser printer 1 is disposed in an orientation in which it is intended to be used. More specifically, in FIG. 1, a left side and a right side are a rear side and a front side, respectively. Further, in FIG. 1, a far side and a near side are a right side and a left side, respectively. Further, in FIG. 1, a top side and a bottom side are a top side and a bottom side, respectively. That is, the left and right sides of the color laser printer 1 will be based on the perspective of a user facing the front side of the color laser printer 1.

<General Structure of Color Laser Printer>

Figure 1:
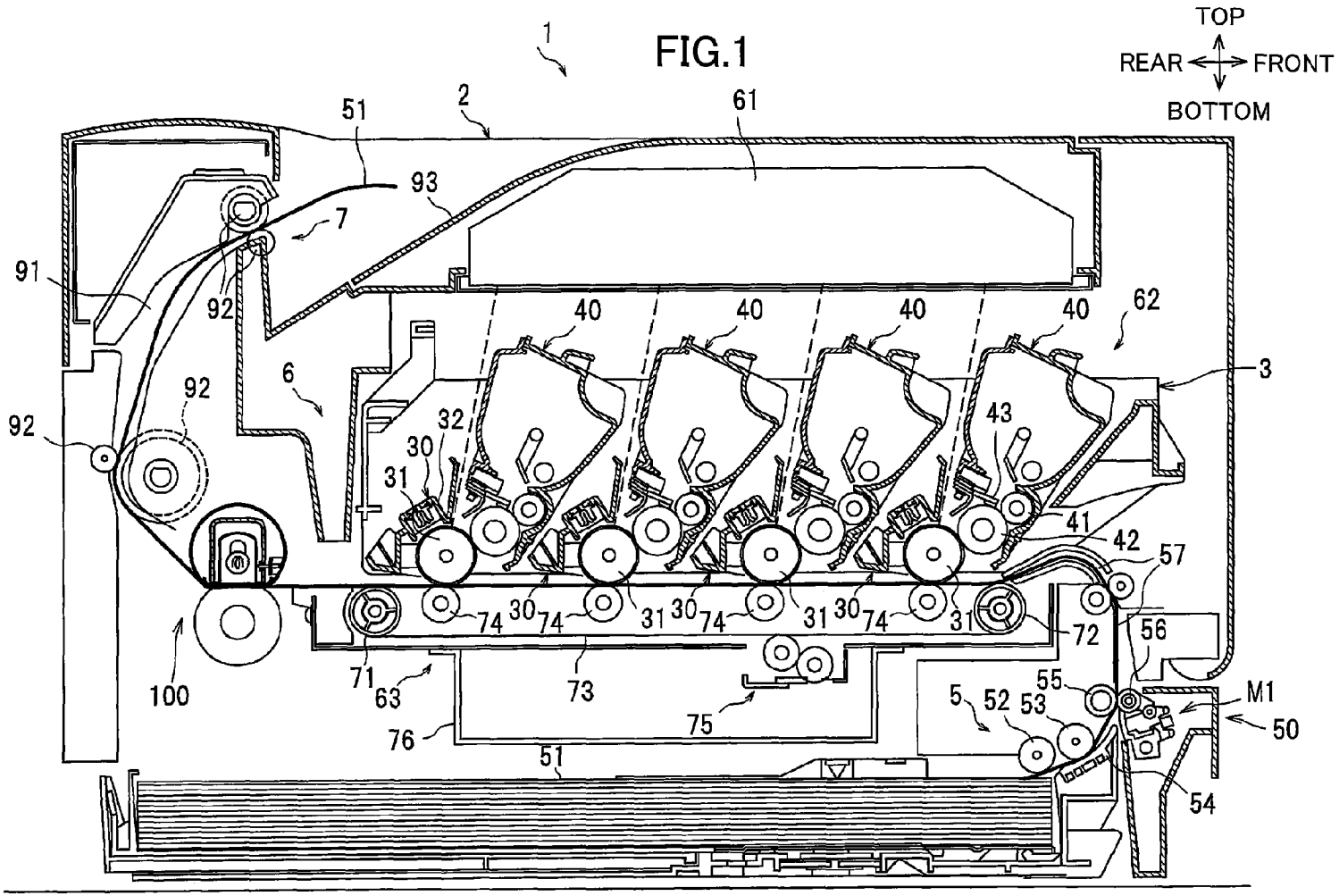
FIG. 1 is a cross-sectional view of a color laser printer provided with a fixing device according to one embodiment of the present invention.

As shown in FIG. 1, the color laser printer 1 includes a main frame 2, a sheet supplying unit 5 for supplying a sheet 51, an image forming unit 6 for forming an image on the sheet 51 to be supplied, and a sheet discharge unit 7 for discharging the sheet 51 on which an image has been formed. The sheet supplying unit 5, the image forming unit 6, and the sheet discharge unit 7 are disposed within the main frame 2.

The sheet supplying unit 5 is disposed at a lower portion of the main frame 2. The sheet supplying unit 5 includes a sheet supply tray 50, and a sheet supplying mechanism M1. The sheet supply tray 50 is mounted in the main frame 2 and detachable from the main frame 2 on a front side thereof by a sliding operation. The sheet supplying mechanism M1 is configured to lift the sheets 51 upward from a front side of the sheet supply tray 50 and then to reverse each sheet 51 to be conveyed rearward.

The sheet supplying mechanism M1 is disposed near a front end portion of the sheet supply tray 50. The sheet supplying mechanism M1 includes a pick-up roller 52, a separation roller 53, a separation pad 54, a paper dust removing roller 55, and a pinch roller 56. A conveying path 57 is provided above the sheet supplying mechanism M1, and a conveyer belt 73 is provided above the sheet supply tray 50 and downstream of the conveying path 57.

An uppermost sheet 51 of the sheets 51 stacked on the sheet supply tray 50 is separated and fed in an upward direction through a cooperative operation of the pick-up roller 52, the separation roller 53, and the separation pad 54. As the sheet 51 fed in the upward direction passes between the paper dust removing roller 55 and the pinch roller 56, paper dust is removed from the sheet 51. Then, the sheet 51 is conveyed along the conveying path 57 while the conveying direction of the sheet 51 is changed to a rearward direction. Subsequently, the sheet 51 is conveyed onto the conveyor belt 73.

The image forming unit 6 includes a scanning unit 61, a process unit 62, a transfer unit 63, and a fixing device 100.

The scanning unit 61 is disposed at an upper portion of the main frame 2. Although not illustrated in the drawings, the scanning unit 61 includes a laser emitting unit, a polygon mirror, a plurality of lenses, and a reflecting mirror. The laser emitting unit emits laser beams corresponding to four colors of cyan, magenta, yellow, and black, and the polygon mirror scans the laser beams at a high speed in a left-right direction. After passing through and reflected by the plurality of lenses and the reflecting mirror, the laser beams irradiate surfaces of photosensitive drums 31 (described later).

The process unit 62 is disposed below the scanning unit 61 and above the sheet supplying unit 5. The process unit 62 includes a drum unit 3. The drum unit 3 is mountable and detachable relative to the main frame 2 in a front-rear direction. The drum unit 3 includes a plurality of (four in the embodiment) sub drum units 30 and a plurality of (four in the embodiment) developing cartridges 40 corresponding to the plurality of sub drum units 30.

The plurality of sub drum units 30 is disposed in a lower portion of the drum unit 3. Each sub drum unit 30 includes the photosensitive drum 31 and a scorotron charger 32, both having a known configuration.

Each developing cartridge 40 accommodates therein toner of specific color, and includes a toner supply roller 41, a developing roller 42, and a layer thickness regulation blade 43, each having a known configuration.

During an image forming operation, in the developing cartridge 40, the toner accommodated in the developing cartridge 40 is supplied to the developing roller 42 through the toner supply roller 41. At this time, the toner is tribo-charged with a positive polarity. The toner supplied to the developing roller 42 becomes a thin layer having a uniform thickness by the layer thickness regulation blade 43 in accordance with the rotation of the developing roller 42.

Meanwhile, in the sub drum unit 30, the scorotron charger 32 applies a uniform charge to the surface of the photosensitive drum 31 with a positive polarity through corona discharge. Then, the surface of the photosensitive drum 31 is subjected to high speed scan of the laser beam from the scanning unit 61 based on image data corresponding to an image to be formed on the sheet 51. Thus, an electrostatic latent image is formed on the surface of the photosensitive drum 31.

As the photosensitive drum 31 rotates, the toner carried on the developing roller 42 is supplied to the electrostatic latent image formed on the photosensitive drum 31, that is, an area of the uniformly positively charged surface of the photosensitive drum 31 whose electric potential is lowered as a result of exposure to the laser beam. Thus, a visible toner image corresponding to the electrostatic latent image of each color of the toner is formed on the surface of the photosensitive drum 31 through reverse development.

The transfer unit 63 includes a drive roller 71, a driven roller 72, the conveyor belt 73, a plurality of transfer rollers 74, and a cleaning unit 75. The drive roller 71 and the driven roller 72 are disposed parallel to and spaced apart from each other. The conveyor belt 73 is configured of an endless belt, and looped around the drive roller 71 and the driven roller 72 with an outer surface of the conveyer belt 73 in contact with the photosensitive drums 31. The transfer rollers 74 are disposed in opposition to the corresponding photosensitive drums 31 with the upper portion of the conveyor belt 73 interposed therebetween. A transfer bias is applied to each transfer roller 74 by a high-voltage circuit board (not illustrated). During the image forming operation, the sheet 51 conveyed by the conveyor belt 73 is nipped between the photosensitive drums 31 and the transfer rollers 74, whereby toner images are transferred onto the sheet 51 from the photosensitive drums 31.

The cleaning unit 75 is disposed below the conveyor belt 73. The cleaning unit 75 is configured to remove toner deposited on the conveyor belt 73 and collect the removed toner in a toner reservoir 76 disposed below the cleaning unit 75.

The fixing device 100 is disposed rearward of the transfer unit 63. The toner images transferred onto the sheet 51 are thermally fixed thereon while the sheet 51 passes through the fixing device 100.

A discharge conveying path 91 is formed in the sheet discharge unit 7 so as to extend upward from an outlet of the fixing device 100 and then curve forward. A plurality of conveying rollers 92 for conveying the sheet 51 is disposed on the discharge conveying path 91. A discharge tray 93 is provided on an upper surface of the main frame 2 for accommodating the sheet 51 on which an image has been formed. The sheet 51 on which an image has been formed is discharged from the discharge conveying path 91 by the conveying rollers 92 to be accommodated on the discharge tray 93.

<Detailed Structure of Fixing Device>

Figure 2:
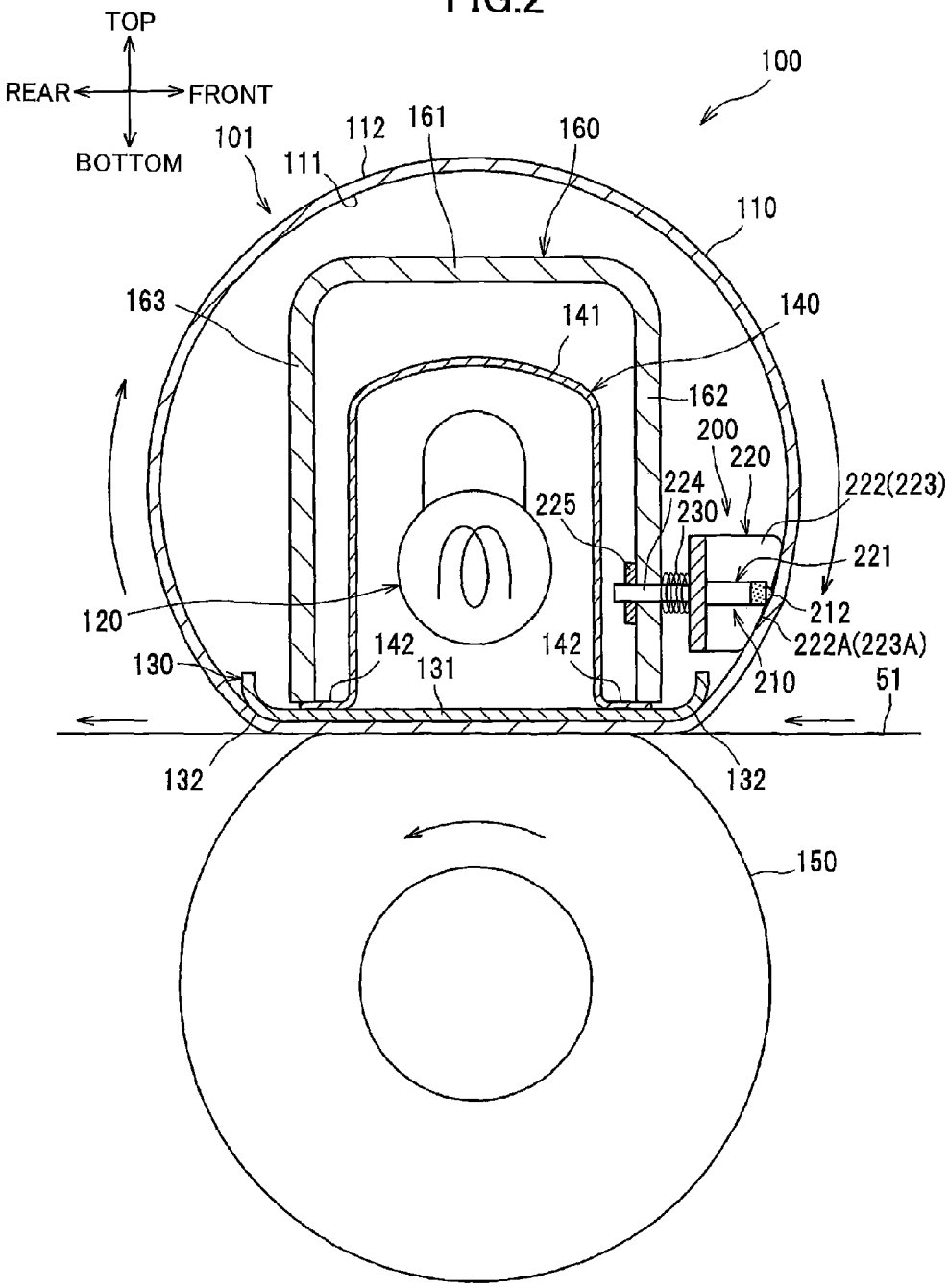
FIG. 2 is a cross-sectional view of the fixing device.

As shown in FIG. 2, the fixing device 100 includes a heating unit 101 and a pressure roller 150 for providing a nip region in cooperation with the heating unit 101.

The heating unit 101 includes a fusing belt (as an example of an endless belt) 110, a halogen lamp (as an example of a heater) 120, a nip plate (as an example of a nip member) 130, a reflection plate 140, a stay (as an example of a support member) 160, and a temperature detection unit 200.

The fusing belt 110 is an endless belt having heat resistivity and flexibility. More specifically, the fusing belt 110 is circularly movable about an axis extending in the left-right direction (as an example of a first direction) and has a generally tubular configuration. Incidentally, the fusing belt 110 may be looped around two rollers and thus have a generally elliptical-shaped cross-section.

The fusing belt 110 is made of metal, such as stainless steel. The fusing belt 110 has an inner peripheral surface 111 in sliding contact with the nip plate 130 and the temperature detection unit 200, and an outer peripheral surface 112 in sliding contact with the pressure roller 150. The inner peripheral surface 111 slidingly moves rearward relative to the nip plate 130. In other words, the inner peripheral surface 111 moves rearward at a position where the inner peripheral surface 111 is in sliding contact with the nip plate 130. More specifically, the sliding direction of the inner peripheral surface 111 relative to the nip plate 130 is a rearward direction.

Incidentally, the fusing belt 110 may include a rubber layer formed over a surface of the metallic tube, and may further include a nonmetallic protective layer such as fluorine coating formed over a surface of the rubber layer.

The halogen lamp 120 is a heater for heating toner on the sheet 51 by heating the nip plate 130 and the fusing belt 110. The halogen lamp 120 is disposed, at an internal space of the fusing belt 110, away from an inner surface (i.e. upper surface) of the nip plate 130 and from the inner peripheral surface 111 of the fusing belt 110 by predetermined intervals.

The nip plate 130 is a plate-like member for receiving radiant heat from the halogen lamp 120. The fusing belt 110 is nipped between the nip plate 130 and the pressure roller 150. The nip plate 130 conveys the radiant heat received from the halogen lamp 120 to the toner on the sheet 51 through the fusing belt 110.

The nip plate 130 has a generally U-shaped cross-section and is made of a metallic material such as aluminum having a thermal conductivity higher than that of the stay 160 (described later) made of steel. More specifically, for fabricating the nip plate 130, an aluminum plate is bent into substantially U-shape to provide a base portion 131 and folded portions 132. When viewed in cross-section, the base portion 131 extends in the front-rear direction, and the folded portions 132 are folded upward from both ends (i.e. front and rear ends) of the base section 131.

The reflection plate 140 is adapted to reflect the radiant heat from the halogen lamp 120 (most of the radiant heat is emitted in the front-rear direction and in an upward direction) toward the nip plate 130 (an inner surface, i.e. upper surface, of the base portion 131). The reflection plate 140 is disposed at the internal space of the fusing belt 110 and surrounds the halogen lamp 120 with a predetermined distance therefrom.

Thus, the radiant heat from the halogen lamp 120 can be efficiently concentrated onto the nip plate 130 by the reflection plate 140 to promptly heat the nip plate 130 and the fusing belt 110.

The reflection plate 140 has a generally U-shaped cross-section and is made of a material such as aluminum having high reflection ratio regarding an infrared ray and a far infrared ray. More specifically, the reflection plate 140 has a reflection portion 141 having a generally U-shaped (curved) cross-section, and flange portions 142 extending outward in the front-rear direction from both ends (i.e. front and rear ends) of the reflection portion 141. Incidentally, a mirror surface finishing is applicable on the surface of the reflection plate 140 in order to enhance the heat reflection ratio of the reflection plate 140.

The stay 160 is a member for ensuring rigidity of the nip plate 130 by supporting both front and rear ends of the base portion 131 of the nip plate 130 through the flange portions 142 of the reflection plate 140. The stay 160 is disposed opposite to the pressure roller 150 with respect to the nip plate 130. The stay 160 has a generally U-shaped cross-section, including an upper wall 161, a front wall 162, and a rear wall 163. The front wall 162 extends downward from a front end of the upper wall 161, and the rear wall 163 extends downward from a rear end of the upper wall 161. The stay 160 is disposed so as to cover the reflection plate 140. The stay 160 is formed by bending a steel plate or any other plate having high rigidity into a generally U-shape.

The pressure roller 150 is a resiliently deformable member. The pressure roller 150 is disposed below the nip plate 130. The resiliently deformed pressure roller 150 nips the fusing belt 110 in cooperation with the nip plate 130 to provide the nip region between the pressure roller 150 and the fusing belt 110.

The pressure roller 150 is driven to rotate upon transmission of a drive force from a drive motor (not illustrated) disposed in the main frame 2. By the rotation of the pressure roller 150, the fusing belt 110 is circularly moved due to a friction force generated between the pressure roller 150 and the fusing belt 110 or between the sheet 51 and the fusing belt 110.

<Detailed Structure of Temperature Detection Unit>

A detailed structure of the temperature detection unit 200 will be described while referring to FIGS. 2 through 5. Note that, in FIGS. 2 through 5, parts and components in and around the temperature detection unit 200 are simplified and exaggerated. For this reason, in FIG. 3, for example, the left-right length of the stay 160 is illustrated with a dimension different from the actual dimension.

As illustrated in FIG. 2, the temperature detection unit 200 is disposed upstream of the nip plate 130 in a moving direction of the fusing belt 110 at the nip region. More specifically, the temperature detection unit 200 has a front portion disposed frontward of the nip plate 130. In other words, the front portion of the temperature detection unit 200 is disposed upstream of the nip plate 130 in the sliding direction of the inner peripheral surface 111 of the fusing belt 110 (i.e. in the rearward direction).

Figure 3:
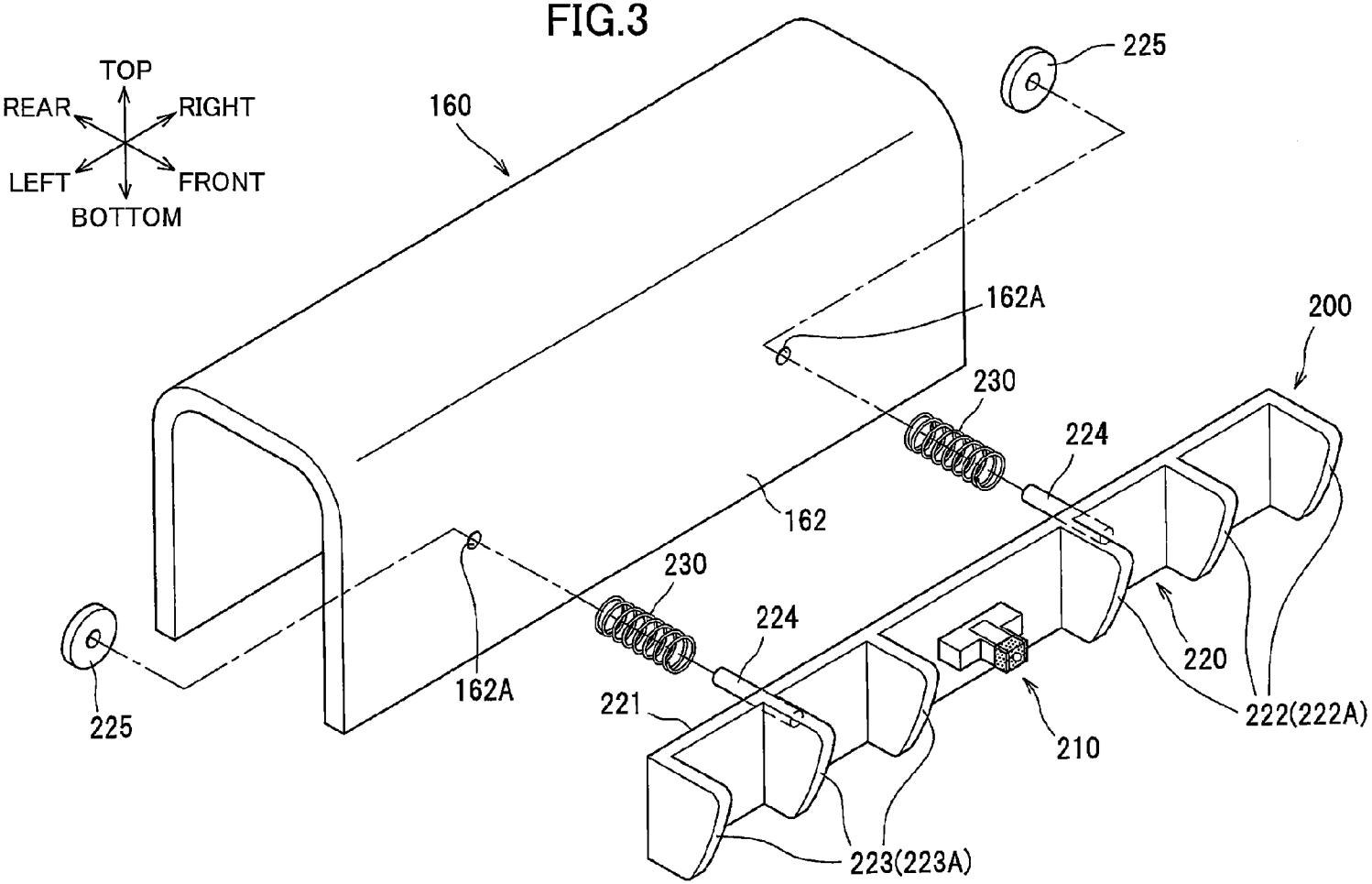
FIG. 3 is an exploded perspective view of a temperature detection unit provided in the fixing device.

As illustrated in FIGS. 2 and 3, the temperature detection unit 200 includes a temperature sensor 210 configured to detect a temperature of the inner peripheral surface 111 of the fusing belt 110, and a holder 220 for retaining the temperature sensor 210.

As illustrated in FIG. 3, the holder 220 integrally includes a plate-like base portion 221 extending in the left-right direction, a plurality of (three in the embodiment) right ribs 222 provided at a right portion of a front surface of the base portion 221, a plurality of (three in the embodiment) left ribs 223 provided at a left portion of the front surface of the base portion 221, and a plurality of (two in the embodiment) shaft portions 224 provided at a rear surface of the base portion 221.

The base portion 221 is oriented in a direction perpendicular to the front-rear direction. The temperature sensor 210 is fixed to a center portion of the front surface of the base portion 221 by an adhesive agent.

The right ribs 222 and the left ribs 223 are disposed on right and left sides of the temperature sensor 210, respectively. Each rib 222, 223 protrudes frontward from the front surface of the base portion 221. Each rib 222, 223 is formed in a generally trapezoidal shape, as viewed in the left-right direction, with a protruding length from the front surface of the base portion 221 gradually decreased toward a downstream side in the moving direction of the fusing belt 110. In other words, an upper portion of each rib 222, 223 has a protruding length from the front surface of the base portion 221 larger than that of a lower portion thereof. Each rib 222, 223 has a front surface serving as a guide surface 222A, 223A configured to guide the inner peripheral surface 111 of the fusing belt 110.

The right guide surfaces 222A and the left guide surfaces 223A are arranged substantially symmetrically in the left-right direction with respect to the temperature sensor 210. With this arrangement, the left-right symmetric guide surfaces 222A, 223A can support the fusing belt 110 in a balanced manner.

The two shaft portions 224 are arranged substantially symmetrically in the left-right direction with respect to the temperature sensor 210. The shaft portions 224 are movably supported by the front wall 162 of the stay 160 through through-holes 162A formed in the front wall 162, whereby the holder 220 of the temperature detection unit 200 is movably supported to the stay 160 in the front-rear direction, that is, in a biasing direction of a compression coil spring 230 (described later). A retaining member 225 is attached to a distal end of each shaft portion 224 inserted through the through-hole 162A.

Each shaft portion 224 extends through the compression coil spring 230 at a position outside of the stay 160. The compression coil spring 230 is a biasing member for biasing the holder 220 toward the inner peripheral surface 111 of the fusing belt 110. Each compression coil spring 230 is disposed between the front wall 162 of the stay 160 and the base portion 221 of the holder 220.

Figure 4:
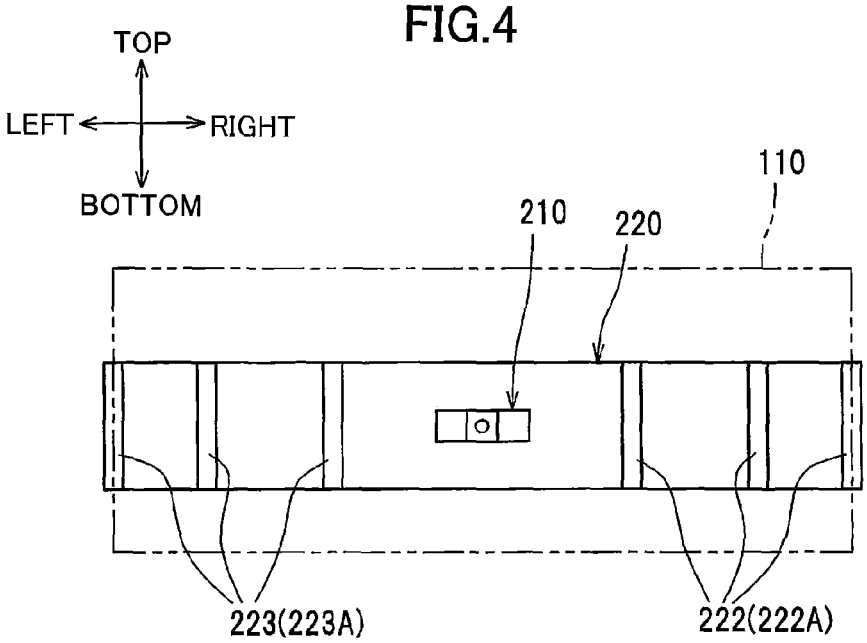
FIG. 4 is an explanatory view illustrating a relationship between a holder and a fusing belt provided in the fixing device.

The holder 220 with the above-described configuration has a dimension in the left-right direction larger than a dimension thereof in the vertical direction (as an example of a second direction) that is perpendicular to the left-right direction, and larger than a dimension thereof in the front-rear direction (as an example of a third direction) that is perpendicular to the left-right direction and the vertical direction. More specifically, as illustrated in FIG. 4, left and right ends of the holder 220 is positioned outward of left and right ends of the fusing belt 110 in the left-right direction, respectively.

Figure 5:
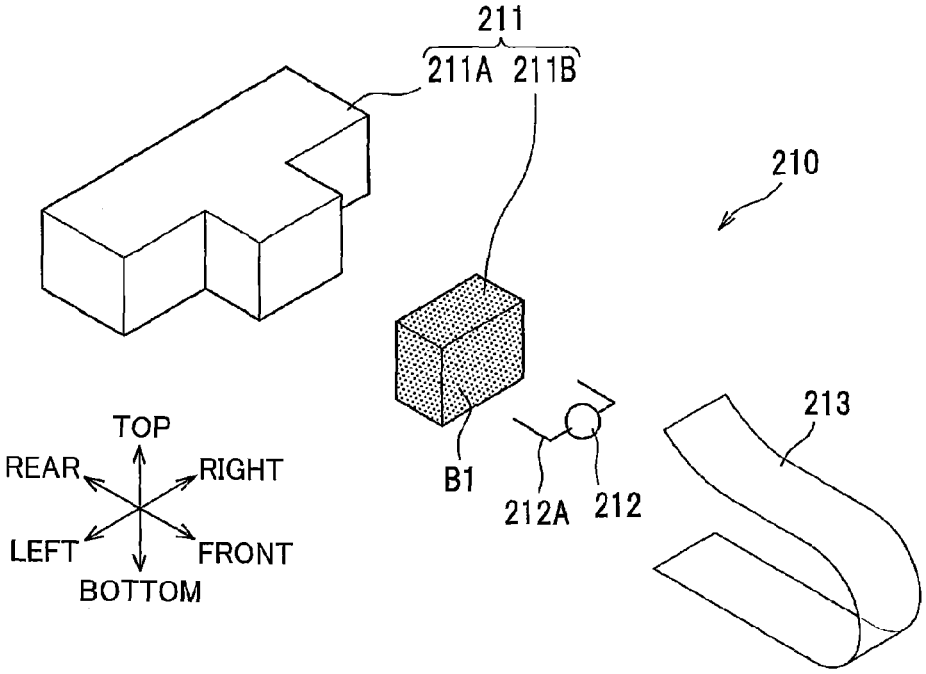
FIG. 5 is an exploded perspective view of a temperature sensor provided in the temperature detection unit.

As illustrated in FIG. 5, the temperature sensor 210 includes a base 211, a sensor element 212, and a film (as an example of a covering layer) 213.

The base 211 includes a T-shaped base portion 211A made of resin, a rectangular-shaped sponge (as an example of a resilient member) 211B. The sponge 211B is provided at a tip end (front end) of the base portion 211A. A surface (rear surface) of the base portion 211A that is positioned opposite to the tip end is fixed to the base portion 221 of the holder 220.

The sensor element 212 is an element for detecting the temperature of the inner peripheral surface 111 of the fusing belt 110. A wiring portion 212A of the sensor element 212 extends through the sponge 211B to be connected to a metal portion (not illustrated) provided in the base portion 211A by insert-molding. The wiring portion 212A is thus connected to a controller (not illustrated) through the metal portion (not illustrated). In other words, the sensor element 212 is supported by the sponge 211B. More specifically, the sensor element 212 is supported at a surface B1 of the sponge 211B facing the inner peripheral surface 111 of the fusing belt 110.

The film 213 is made of a material including fluorine resin. The film 213 is attached to the base 211 by an adhesive agent so as to cover the sensor element 212 from a side opposite to the base 211.

In a state where the temperature sensor 210 with the above-described configuration is attached to the holder 220, the sensor element 212 of the temperature sensor 210 protrudes outward further than the guide surfaces 222A, 223A in the front-rear direction, as illustrated in FIG. 2. In other words, the sensor element 212 is disposed closer to the inner peripheral surface 111 of the fusing belt 110 than the guide surfaces 222A, 223A (more specifically, portions of the guide surfaces 222A, 223A corresponding to the sensor element 212) to the inner peripheral surface 111 of the fusing belt 110.

With this arrangement, the sensor element 212 of the temperature sensor 210 can reliably detect the temperature of the inner peripheral surface 111 of the fusing belt 110.

In addition to the above-described operational advantages, the following operational advantages can be obtained.

According to the above-described embodiment, the holder 220 retaining the temperature sensor 210, more specifically, the holder 220 having right and left guide surfaces 222A, 223A disposed on right and left sides of the temperature sensor 210, is biased toward the inner peripheral surface 111 of the fusing belt 110. Compared with the conventional structure in which the temperature sensor is biased toward the inner peripheral surface of the fusing belt, the holder 220 can prevent a localized force due to local contact of the temperature sensor 210 with the fusing belt 110 from being applied to the fusing belt 110. Further, in a case where an existing temperature sensor including a base and a sensor element is used for the temperature detection unit 200, such an existing temperature sensor can be simply attached to the holder 220. Hence, the cost in association with a change of the temperature sensor can be reduced.

According to the above-described embodiment, the right and left guide surfaces 222A, 223A are provided on right and left sides of the temperature sensor 210, respectively. Hence, the fusing belt 110 can be reliably supported by the right and left guide surfaces 222A, 223A. Accordingly, the holder 220 can further prevent the fusing belt 110 from being subjected to the localized force due to local contact of the temperature sensor 210 with the fusing belt 110.

According to the above-described embodiment, the holder 220 is elongated in the left-right direction. Thus, the plurality of ribs 222, 223 can be arrayed along the left-right direction. Each rib 222, 223 can support the fusing belt 110, thereby further preventing the fusing belt 110 from being subjected to the localized force due to local contact of the temperature sensor 210 with the fusing belt 110.

In particular, in the above-described embodiment, the holder 220 has an elongated configuration such that the left and right ends of the holder 220 is positioned outward of the left and right ends of the fusing belt 110 in the left-right direction, respectively. Hence, the ribs 222, 223 can be formed across the substantially entire left-right width of the fusing belt 110. This arrangement can further prevent the fusing belt 110 from being subjected to the localized force due to local contact of the temperature sensor 210 with the fusing belt 110.

According to the above-described embodiment, the stay 160 supports the holder 220 such that the holder 220 is movable. Hence, the guide surfaces 222A, 223A of the holder 220 can reliably follow the movement of the fusing belt 110, thereby reliably guiding the fusing belt 110. Further, the stay 160 serves as a support member for supporting the holder 220. Hence, the stay 160 can be commonly used for supporting the holder 220 and for supporting the nip plate 130.

According to the above-described embodiment, the sensor element 212 is supported by the sponge 211B. Hence, due to deformation of the compression coil spring 230 as well as deformation of the sponge 211B, the sensor element 212 can reliably follow the movement of the fusing belt 110. Accordingly, the sensor element 212 can reliably detect the temperature of the inner peripheral surface 111 of the fusing belt 110.

According to the above-described embodiment, the sensor element 212 is covered by the film 213. Compared with a structure in which a fusing belt is directly in sliding contact with a sensor element, the film 213 can protect the sensor element 212. Further, since the film 213 includes a fluorine resin, sliding resistance between the fusing belt 110 and the film 213 can be minimized. Hence, the fusing belt 110 can be smoothly circularly moved.

MODIFICATIONS

Various modifications are conceivable. In the following description, only parts differing from those of the embodiment will be described in detail.

First Modification

Figure 6:
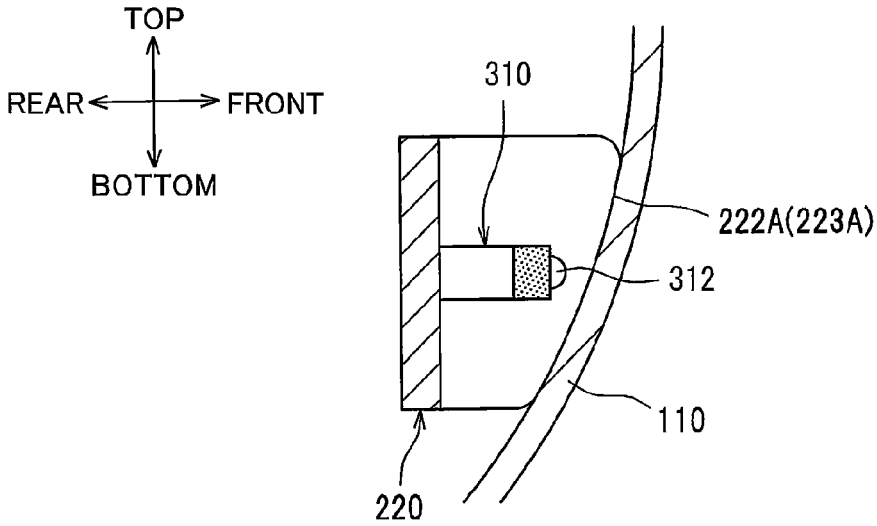
FIG. 6 is a cross-sectional view illustrating a state where a sensor element is arranged spaced apart from a fusing belt in a fixing device according to a first modification of the present invention.

In the above-described embodiment, the sensor element 212 protrudes outward further than the guide surfaces 222A, 223A in the front-rear direction. However, as illustrated in FIG. 6, a temperature sensor 310 can be configured such that a sensor element 312 detects the temperature of inner peripheral surface 111 of the fusing belt 110 in a non-contact manner. In this case, the sensor element 312 does not necessarily protrude toward the inner peripheral surface 111 further than the guide surfaces 222A, 223A toward the inner peripheral surface 111. The sensor element 312 can be disposed away further from the fusing belt 110 than the guide surfaces 222A, 223A from the fusing belt 110 in a direction away from the fusing belt 110. With this configuration, the fusing belt 110 is not in sliding contact with the sensor element 312. Hence, damages to the sensor element 312 and the fusing belt 110 can be prevented.

Second Modification

Figure 7:
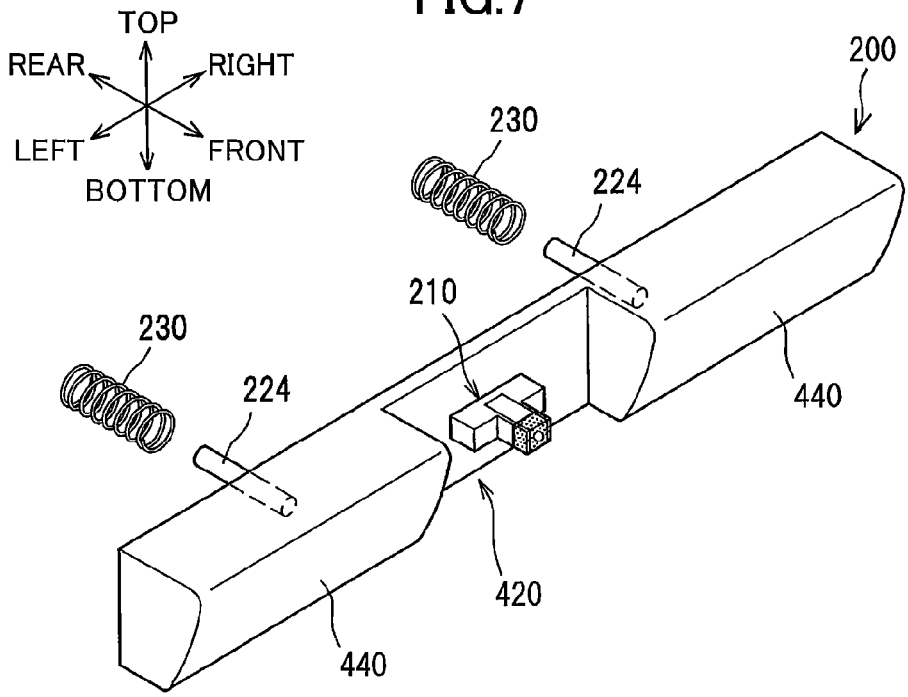
FIG. 7 is a perspective view of a temperature detection unit in a fixing device according to a second modification of the present invention, in which modified guide surfaces are illustrated.

In the above-described embodiment, the front surfaces of the ribs 222, 223 serve as the guide surfaces 222A, 223A. However, as illustrated in FIG. 7, a holder 420 can be provided with two guide surfaces 440 each having a left-right width larger than that of the rib 222, 223. However, the ribs 222, 223, each having a narrower width than that of the guide surface 440, can reduce sliding resistance between the fusing belt 110 and the guide surfaces 222A, 223A, compared with the guide surfaces 440. Hence, the guide surfaces 222A, 223A can more reliably guide the fusing belt 110 with less sliding resistance.

Third Modification

Figure 8:
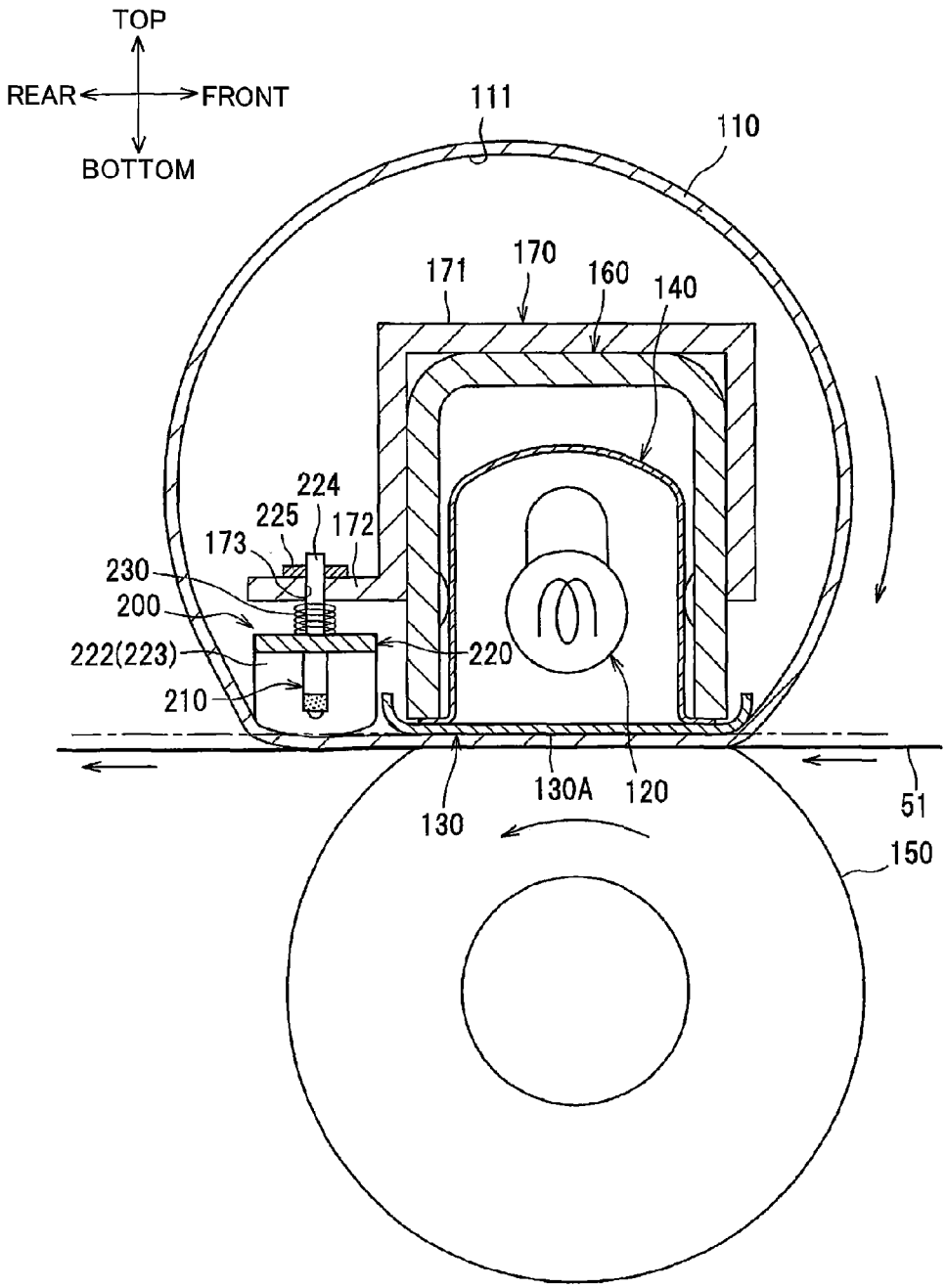
FIG. 8 is a cross-sectional view of a fixing device according to a third modification of the present invention, in which a temperature detection unit is positioned downstream of a nip plate in a sliding direction.

In the above-described embodiment, a portion of the temperature detection unit 200 is disposed upstream of the nip plate 130 in the sliding direction of the inner peripheral surface 111 of the fusing belt 110. Alternatively, the temperature detection unit 200 in its entirety may be disposed upstream of the nip plate 130 in the sliding direction of the inner peripheral surface 111 of the fusing belt 110. However, as illustrated in FIG. 8, the temperature detection unit 200 can be disposed downstream of the nip plate 130 in the sliding direction. In FIG. 8. the temperature detection unit 200 in its entirety is disposed downstream of the nip plate 130 in the sliding direction. However, it is only necessary that at least a portion of the temperature detection unit 200 is disposed on a downstream side of the nip plate 130 in the sliding direction.

Further, in FIG. 8, the temperature detection unit 200, more specifically, the ribs 222, 223 of the holder 220, protrudes downward further than a contact surface 130A of the nip plate 130 with which the fusing belt 110 is in sliding contact. With this arrangement, the temperature detection unit 200 having a portion protruding downward further than the contact surface 130A can prevent a portion of the fusing belt 110 positioned downstream of the nip plate 130 in the sliding direction from being bent inward.

Further, in FIG. 8, a stay cover 170 is available for the support member for movably supporting the holder 220, instead of the stay 160. The stay cover 170 has a main portion 171 having a generally U-shaped cross-section and covering the stay 160 from above, and a flange portion 172 extending rearward from a lower end of a rear wall of the main portion 171. The flange portion 172 is formed with holes 173 through which the shaft portions 224 of the holder 220 vertically movably extend.

Incidentally, not only the stay 160 and the stay cover 170 but also other members are available for the support member.

Fourth Modification

Figure 9:
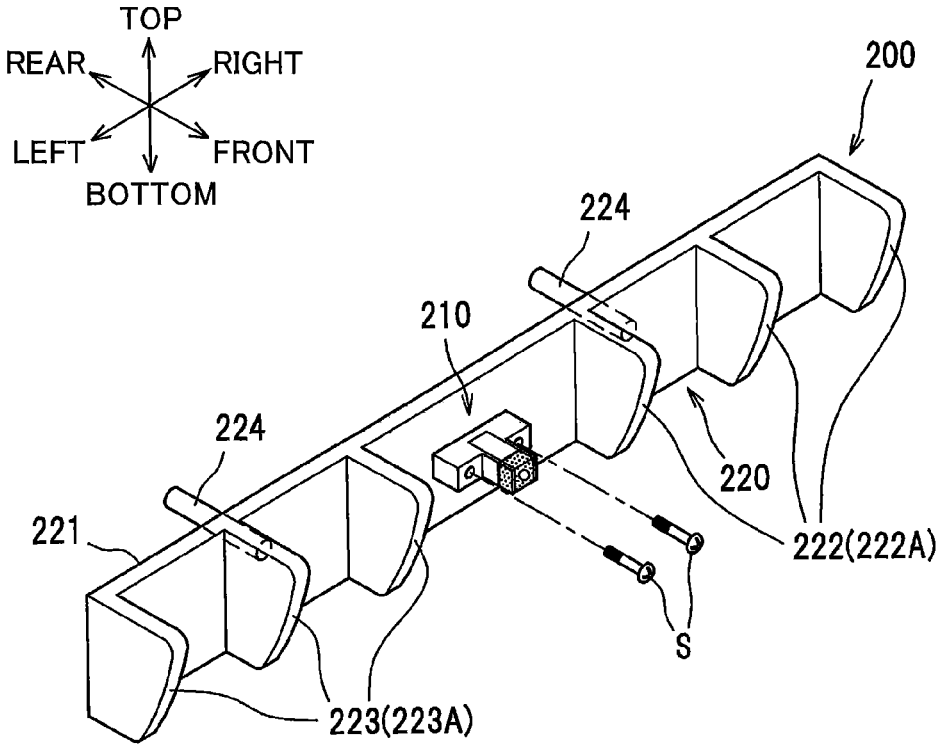
FIG. 9 is a perspective view of a temperature detection unit provided in a fixing device according to a fourth modification of the present invention, in which a temperature sensor is fixed to a base portion of a holder by screws.

In the above-described embodiment, the temperature sensor 210 is fixed to the base portion 221 of the holder 220 by an adhesive agent. However, as illustrated in FIG. 9, the temperature sensor 210 is fixed to the base portion 221 by screws S.

Fifth Modification

Figure 10A:
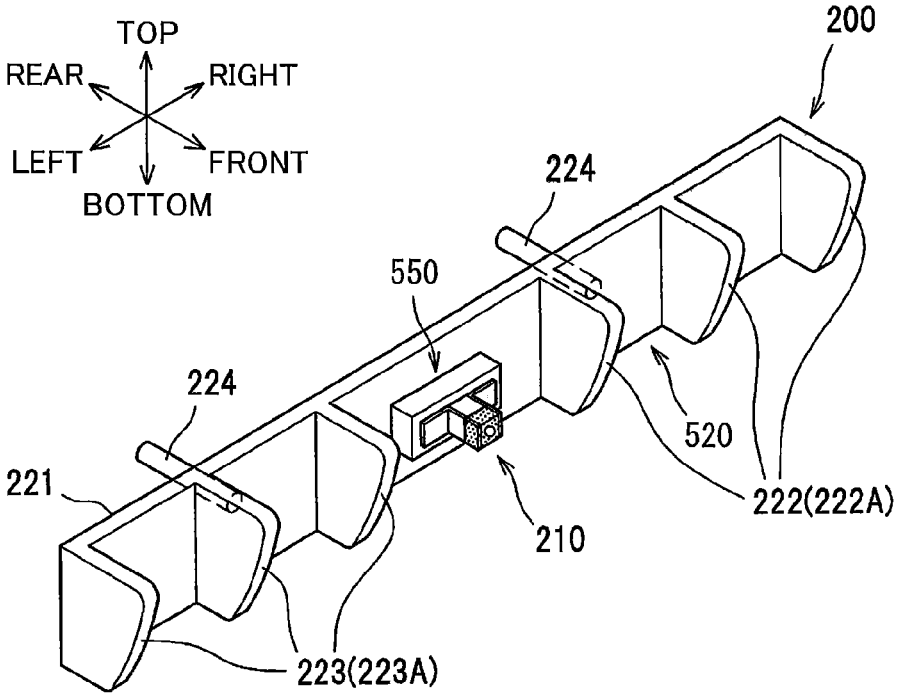
FIG. 10A is a perspective view of a temperature detection unit provided in a fixing device according to a fifth modification of the present invention, in which a retaining portion for retaining a temperature sensor is provided at a base portion of a holder.
Figure 10B:
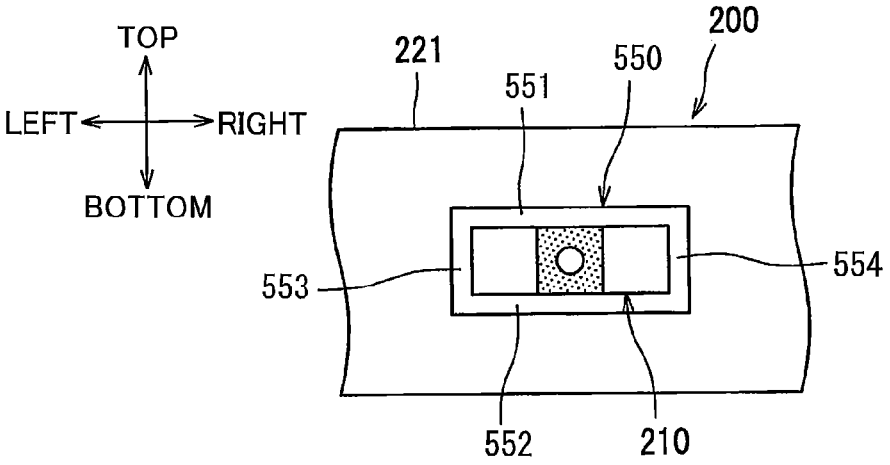
FIG. 10B is a partial enlarged front view of the temperature detection unit provided in the fixing device according to the fifth modification, in which the retaining portion and a part of the base portion are illustrated.

Further, as illustrated in FIGS. 10A and 10B, a holder 520 includes a retaining portion 550 provided at a left-light center portion of the base portion 221. The retaining portion 550 has a generally rectangular tubular shape, and protrudes forward (toward the fusing belt 110) from the base portion 221 of the holder 520. The temperature sensor 210 can be retained in the retaining portion 550.

More specifically, the retaining portion 550 has a first wall 551, a second wall 552, a third wall 553, and a fourth wall 554. The temperature sensor 210 is interposed between the first wall 551 and the second wall 552 in the vertical direction, and interposed between the third wall 553 and the fourth wall 554 in the left-right direction. With this structure, the retaining portion 550 can reliably restrain the temperature sensor 210 from being displaced in the vertical and left-right directions.

Others

In the above-described embodiment, the film 213 is exemplified as the covering layer. However, a coated layer including fluorine resin is available instead of the film 213.

In the above-described embodiment, the guide surfaces 222A, 223A are provided on the right and left sides of the temperature sensor 210, respectively. However, the guide surfaces can be provided on either one of the right and left sides of the temperature sensor 210.

Incidentally, the numbers of the right ribs 222, the left ribs 223, the shaft portions 224, and the compression coil spring 230 are not limited to those in the above-described embodiment, and can be arbitrarily set.

In the above-described embodiment, the left and right ends of the holder 220 is positioned outward of the left and right ends of the fusing belt 110 in the left-right direction, respectively. However, the left and right ends of the holder 220 can be aligned with the left and right ends of the fusing belt 110 in the left-right direction, respectively.

In the above-described embodiment, the nip plate 130 is exemplified as the nip member. However, in place of a plate-like shape, the nip member can be formed in a block-like shape or a pad-like shape.

In the above-described embodiment, the halogen lamp 120 is exemplified as the heater. However, a carbon heater, an IH (induction heating) heater, or a ceramic heater is available instead of the halogen lamp 120. Here, the IH heater implies a heater that does not generate heat but heats the metallic fusing belt and the metallic nip plate by electromagnetic induction.

In the above-described embodiment, the compression coil spring 230 is exemplified as the biasing member. However, an extension coil spring, a leaf spring, or a wire spring is available instead of the compression coil spring 230. Further, in the above-described embodiment, the sponge 211B is exemplified as the resilient member. However, a felt or a rubber is available instead of the sponge 211B.

Further, the above-described embodiment is applied to the color laser printer 1. However, the present invention is also available to an image forming apparatus other than a color laser printer, such as a monochromatic laser printer, a copying machine and a multifunction device.

While the present invention has been described in detail with reference to the embodiments thereof, it would be apparent to those skilled in the art that various changes and modifications may be made therein without departing from the spirit of the present invention.

What is claimed is:

1. A fixing device comprising:

a nip member elongated in a first direction;

an endless belt having an inner peripheral surface, the endless belt having a first end in the first direction and a second end opposite to the first end in the first direction, the endless belt being configured to circularly move such that the inner peripheral surface moves in a sliding direction at a position where the inner peripheral surface is in sliding contact with the nip member;

a heater configured to heat the endless belt;

a temperature detection unit comprising:

a temperature sensor configured to detect a temperature of the inner peripheral surface, the temperature sensor comprising:

a base having a dimension in the first direction; and a sensor element supported at the base; and a holder having a base portion disposed opposite to the sensor element with respect to the base of the temperature sensor, the base portion of the holder having a dimension in the first direction greater than the dimension of the base of the temperature sensor in the first direction, the base portion of the holder supporting the base of the temperature sensor, the holder having a first guide portion protruding from the base portion of the holder toward the inner peripheral surface, the first guide portion having a first guide surface configured to guide the inner peripheral surface, the first guide surface being disposed on a first side of the temperature sensor in the first direction, the holder being spaced apart from the sensor element; and a biasing member configured to bias the base portion of the holder toward the inner peripheral surface.

2. The fixing device as claimed in claim 1, wherein the holder has a first dimension in the first direction, a second dimension in a second direction perpendicular to the first direction, and a third dimension in a third direction perpendicular to the first and second directions, the first dimension being larger than the second dimension, the first dimension being larger than the third dimension.

3. The fixing device as claimed in claim 1, wherein the first guide surface comprises a plurality of guide surfaces, wherein the first guide portion has a plurality of ribs each provided with one of the plurality of guide surfaces.

4. The fixing device as claimed in claim 1, wherein the holder further has a second guide portion protruding from the base portion of the holder toward the inner peripheral surface, the second guide portion having a second guide surface configured to guide the inner peripheral surface and disposed on a second side of the temperature sensor opposite to the first side of the temperature sensor in the first direction, the temperature sensor being positioned between the first guide portion and the second guide portion.

5. The fixing device as claimed in claim 4, wherein the first guide surface and the second guide surface are arranged symmetrically in the first direction with respect to the temperature sensor.

6. The fixing device as claimed in claim 1, wherein the temperature detection unit has a portion disposed upstream of the nip member in the sliding direction.

7. The fixing device as claimed in claim 1, wherein the temperature detection unit has a portion disposed downstream of the nip member in the sliding direction.

8. The fixing device as claimed in claim 7, wherein the nip member has a contact surface with which the inner peripheral surface is in sliding contact, the temperature detection unit having a portion protruding beyond the contact surface.

9. The fixing device as claimed in claim 1, wherein the sensor element protrudes toward the inner peripheral surface further than the first guide surface toward the inner peripheral surface.

10. The fixing device as claimed in claim 1, wherein the temperature sensor further comprises a covering layer for covering the sensor element, and wherein the base of the temperature sensor comprises a resilient member for supporting the sensor element, the covering layer being disposed opposite to the resilient member with respect to the sensor element.

11. The fixing device as claimed in claim 10, wherein the resilient member is formed of a sponge and the covering layer is formed of a film.

12. The fixing device as claimed in claim 1, wherein the sensor element is disposed away from the endless belt further than the first guide surface from the endless belt in a direction away from the endless belt.

13. The fixing device as claimed in claim 1, wherein the holder has a first end in the first direction and a second end opposite to the first end of the holder in the first direction, the first end of the holder and the second end of the holder being aligned with the first end of the endless belt and the second end of the endless belt in the first direction, respectively.

14. The fixing device as claimed in claim 1, wherein the base portion of the holder has a support surface for supporting the base of the temperature sensor, the first guide portion being spaced apart from the temperature sensor in the first direction.

15. The fixing device as claimed in claim 1, wherein the holder further has a second guide portion protruding from the base portion of the holder toward the inner peripheral surface, the second guide portion having a second guide surface configured to guide the inner peripheral surface, the second guide portion being spaced apart from the first guide portion in the first direction.

16. The fixing device as claimed in claim 15, wherein the second guide portion being disposed opposite to the temperature sensor with respect to the first guide portion.

17. The fixing device as claimed in claim 1, wherein the holder further has a second guide portion protruding from the base portion of the holder toward the inner peripheral surface, the second guide portion having a second guide surface configured to guide the inner peripheral surface, the base portion of the holder having a support surface for supporting the base of the temperature sensor, the second guide portion being spaced apart from the temperature sensor in the first direction.

18. A fixing device comprising:

a nip member elongated in a first direction;

an endless belt having an inner peripheral surface, the endless belt having a first end on a first side in the first direction and a second end on a second side opposite to the first side in the first direction, the endless belt being configured to circularly move such that the inner peripheral surface moves in a sliding direction at a position where the inner peripheral surface is in sliding contact with the nip member;

a heater configured to heat the endless belt;

a temperature detection unit comprising:

a temperature sensor configured to detect a temperature of the inner peripheral surface, the temperature sensor comprising:

a base; and a sensor element supported at the base; and a holder configured to support the base, the holder having a guide surface configured to guide the inner peripheral surface, the guide surface being disposed on at least one of the first side and the second side of the temperature sensor;

a biasing member configured to bias the holder in a biasing direction toward the inner peripheral surface; and a support member configured to movably support the holder in the biasing direction, the support member being a stay for supporting the nip member.

19. A fixing device comprising:

a nip member elongated in a first direction;

an endless belt having an inner peripheral surface, the endless belt having a first end on a first side in the first direction and a second end on a second side opposite to the first side in the first direction, the endless belt being configured to circularly move such that the inner peripheral surface moves in a sliding direction at a position where the inner peripheral surface is in sliding contact with the nip member;

a heater configured to heat the endless belt;

a temperature detection unit comprising:

a temperature sensor configured to detect a temperature of the inner peripheral surface, the temperature sensor comprising:

a base; and a sensor element supported at the base; and a holder configured to support the base, the holder having a guide surface configured to guide the inner peripheral surface, the guide surface being disposed on at least one of the first side and the second side of the temperature sensor, the holder having a first end on the first side and a second end on the second side, the first end of the holder and the second end of the holder being positioned outward of the first end of the endless belt and the second end of the endless belt in the first direction, respectively; and a biasing member configured to bias the holder toward the inner peripheral surface.

* * * * *